US007862259B2

(12) United States Patent
Carpenter

(10) Patent No.: US 7,862,259 B2
(45) **Date of Patent: *Jan. 4, 2011**

(54) EROSION CONTROL MAT ANCHOR SYSTEM

(75) Inventor: Thomas J. Carpenter, Ankeny, IA (US)

(73) Assignee: Erosion Tech, LLC, Ankeny, IA (US)

( * ) Notice: Subject to any disclaimer, the term of this patent is extended or adjusted under 35 U.S.C. 154(b) by 406 days.

This patent is subject to a terminal disclaimer.

(21) Appl. No.: 11/500,811

(22) Filed: Aug. 8, 2006

(65) Prior Publication Data

US 2008/0034682 A1 Feb. 14, 2008

(51) Int. Cl.
*E02D 17/20* (2006.01)
*E02D 5/80* (2006.01)

(52) U.S. Cl. ..... 405/302.7; 405/259.1; 405/302.6; 52/166

(58) Field of Classification Search ..... 405/258.1, 405/259.7, 302.4, 302.6, 302.7, 303; 52/155, 52/156, 166; 24/69 CT, 69 ST
See application file for complete search history.

(56) References Cited

U.S. PATENT DOCUMENTS

| | | | | | |
|---|---|---|---|---|---|
| 360,225 | A | * | 3/1887 | Kanters | 405/19 |
| 1,092,203 | A | * | 4/1914 | Carter | 24/69 ST |
| 3,139,163 | A | * | 6/1964 | Haller | 52/155 |
| 3,570,254 | A | * | 3/1971 | Turzillo | 405/18 |
| 4,003,169 | A | * | 1/1977 | Young, II | 52/155 |
| 4,054,267 | A | * | 10/1977 | Berg et al. | 410/37 |
| 4,243,350 | A | * | 1/1981 | Hall | 410/100 |
| 4,596,731 | A | | 6/1986 | Cudmore et al. | |
| 4,610,568 | A | * | 9/1986 | Koerner | 405/19 |
| 4,611,446 | A | * | 9/1986 | Beavers et al. | 52/163 |
| 4,727,693 | A | * | 3/1988 | Rockenfeller et al. | 52/163 |
| 4,802,317 | A | * | 2/1989 | Chandler | 52/163 |
| 4,936,194 | A | * | 6/1990 | Horowitz | 52/155 |
| 5,031,370 | A | * | 7/1991 | Jewett | 52/166 |
| 5,058,337 | A | * | 10/1991 | O'Connor | 52/162 |
| 5,171,108 | A | * | 12/1992 | Hugron | 405/259.1 |
| 5,175,966 | A | * | 1/1993 | Remke et al. | 52/163 |
| 5,256,007 | A | | 10/1993 | Allen | |
| 5,358,356 | A | | 10/1994 | Romanek et al. | |
| 5,364,206 | A | | 11/1994 | Marienfeld | |
| 5,428,935 | A | * | 7/1995 | Mitchell | 52/698 |
| 5,476,339 | A | | 12/1995 | Baranowski | |
| 5,484,230 | A | | 1/1996 | Rudloff | |
| 5,584,600 | A | | 12/1996 | Langdon | |
| 5,651,641 | A | | 7/1997 | Stephens et al. | |
| 5,775,037 | A | * | 7/1998 | James | 52/163 |
| 5,820,294 | A | | 10/1998 | Baranowski | |

(Continued)

OTHER PUBLICATIONS

Georunner Surface Protection System, two page brochure.

(Continued)

*Primary Examiner*—Tara Mayo-Pinnock
(74) *Attorney, Agent, or Firm*—Shook, Hardy & Bacon L.L.P.

(57) ABSTRACT

An anchor system for an erosion control surface. The system includes a resilient strap and a one-way retainer, which may be inserted utilizing a single operator and inexpensive tools. The resiliency of the system biases the erosion control surface into the ground and prevents undesired movement of the erosion control surface.

12 Claims, 5 Drawing Sheets

U.S. PATENT DOCUMENTS

| | | | | |
|---|---|---|---|---|
| 5,833,400 | A * | 11/1998 | Wamsher | 405/244 |
| 5,881,506 | A * | 3/1999 | Chapman et al. | 52/166 |
| 5,951,202 | A | 9/1999 | Brown | |
| 6,027,285 | A | 2/2000 | Angel et al. | |
| 6,171,022 | B1 * | 1/2001 | Decker | 52/155 |
| 6,237,289 | B1 * | 5/2001 | Jewett et al. | 52/163 |
| 6,370,827 | B2 * | 4/2002 | Chalich | 52/155 |
| 6,401,408 | B1 * | 6/2002 | Schwartz et al. | 52/155 |
| 6,461,084 | B1 * | 10/2002 | Stuart | 405/244 |
| 6,474,028 | B2 * | 11/2002 | Cusimano et al. | 52/153 |
| 6,527,407 | B2 | 3/2003 | Bluck | |
| 6,558,074 | B2 | 5/2003 | Jansson | |
| 6,572,308 | B1 * | 6/2003 | Busto | 405/259.1 |
| 6,579,038 | B1 | 6/2003 | McAllister et al. | |
| 6,592,292 | B1 | 7/2003 | Jansson | |
| 6,612,776 | B1 | 9/2003 | Jansson | |
| 6,824,331 | B2 * | 11/2004 | Parker | 405/259.1 |
| 6,835,027 | B1 * | 12/2004 | Glass | 405/302.7 |
| 6,863,472 | B2 | 3/2005 | Jansson | |
| 6,942,421 | B2 | 9/2005 | Jansson | |
| 6,951,438 | B2 | 10/2005 | Carpenter | |
| 7,033,109 | B2 * | 4/2006 | Russell et al. | 405/45 |
| 7,083,358 | B2 | 8/2006 | Grosjean | |
| 2001/0045068 | A1 * | 11/2001 | Chalich | 52/157 |
| 2003/0017000 | A1 | 1/2003 | Jansson | |
| 2003/0019080 | A1 * | 1/2003 | Anthony et al. | 24/68 R |
| 2003/0022134 | A1 * | 1/2003 | Seniuk | 433/229 |
| 2003/0082015 | A1 * | 5/2003 | Christensen | 405/302.6 |
| 2003/0228192 | A1 | 12/2003 | Jansson | |
| 2004/0013467 | A1 | 1/2004 | Jansson | |
| 2005/0078475 | A1 | 4/2005 | Byers et al. | |

OTHER PUBLICATIONS

Non-final OA mailed Jan. 8, 2009 U.S. Appl. No. 12/214,346.
Non-final OA mailed Aug. 6, 2009, U.S. Appl. No. 12/214,346.
Notice of Allowance mailed Dec. 1, 2009, U.S. Appl. No. 12/214,346.
Non-final OA mailed Jun. 11, 2009, U.S. Appl. No. 11/827,639.
Non-final OA mailed Feb. 2, 2010, U.S. Appl. No. 11/827,639.

* cited by examiner

EROSION CONTROL MAT ANCHOR SYSTEM

BACKGROUND OF THE INVENTION

1. Field of the Invention

The present invention relates in general to an anchor system for anchoring material to the ground and, more particularly, to a system for anchoring an erosion control surface to the ground.

2. Description of the Prior Art

The Clean Water Act and subsequent legislation requires storm water to be discharged in a non-erosive manner. Unfortunately, storm water pipe outlets and the like used to divert water runoff are highly erosive at their outlets as the result of velocity and shear force problems associated with the funneling of water toward a narrow outlet. Erosion control associated with such outlets involves economic, physical and logistical problems. Traditionally, storm water is transported from a street or parking lot in a storm water pipe to a conveyance, such as a stream or river. Storm water may also be drained from a permanent structure, like a parking lot, at designated outlets where it flows overland and naturally dissipates. The soil area adjacent such discharge points is highly susceptible to severe erosion associated with discharging water.

The energy of water discharging from such outlets varies with the velocity, shear force and volume of the effluent. Water 25 centimeters deep, flowing rapidly, is much more erosive and destructive than water 8 centimeters deep, flowing at the same rate. Accordingly, allowing runoff water to spread out is an effective means to counteract funneling of discharge water, dissipating both velocity and shear force without mechanical input. Conversely, squeezing water raises its height and increases its hydraulic pressure. This increase in hydraulic pressure results in increased shear force which, in turn, leads to increased erosion. Unfortunately, the factors associated with diverting water, namely collecting water from a relatively large area and funneling it to a very small area, using hard, smooth surfaces, cannot help but magnify the weight, velocity and shear force of the water at the discharge point.

Traditionally, at such discharge points, material, such as rip rap, is added. Such installation of various sized rocks, stacked in a concave manner to funnel water, may be used to reduce erosion, but is very expensive and time consuming to install. Alternatively, concrete blankets (flat soft material filled with concrete or concrete blocks held together with steel cables), or concrete slabs may be used to control erosion at discharge points. These products, and other similar products, are referred to as "hard armor." Hard armor often dissipates water energy and protects the soil therebeneath from eroding away and polluting natural resources. One drawback associated with hard armor is the requirement of very large equipment needed to install the hard armor. Additionally, a significant volume of material must be freighted to the site and a large amount of preparatory work is required before installing the hard armor.

While hard armor is useful for dissipating velocity and countering shear forces associated with runoff water, poor installation often allows the water to splash or divert out of the designated channel, many times leading to the erosion and washout of the hard armor installation itself. While concrete blankets are better able to withstand velocity and shear forces, they do little to inhibit the velocity and, therefore, the destructive force of water runoff. Another drawback associated with hard armor is that it typically lacks aesthetics associated with other forms of erosion control.

Recently, the industry has developed blanket-type products called turf reinforcement mats to convey water and withstand designated loads. While such turf reinforcement mats do little to reduce or mechanically dissipate the energy of runoff water energy themselves, their installation allows for the growth of vegetation which, in turn, mechanically reduces energy associated with runoff water. Such blankets are typically three-dimensional, flexible mats constructed of plastic webbing. The open weave of such mats allows vegetation to grow up therethrough. The combination of the mechanical stable structure and open weave design results in a significant synergistic effect, with the capacity to carry much greater velocity and sheet force load because roots and stems associated with the upgrowing vegetation are reinforced by the mat.

It is also known in the art to provide an erosion control transition mat as described in U.S. Letters Pat. No. 6,951,438 to reduce erosion. The erosion control transition mat is more rigid than turf reinforcement mats. Unlike turf reinforcement mats or hard armor, the erosion control transition mats allow for vegetative growth therethrough. Although turf reinforcement mats and erosion control transition mats have numerous advantages over the prior art in terms of reducing erosion, it is often difficult to securely mount these types of mats in an erosion susceptible area. While the mats may obviously be secured into concrete blankets, if it is desired to secure the mats directly to the soil, complex and expensive anchoring systems requiring specialized tools and multiple installers are typically required. One method of installation involves securing a pivoting anchor to a cable and driving the anchor and cable through the mat into the soil. The cable is then lifted upward to pivot and lock the anchor. One installer thereafter pulls upward on the cable, while a second installer swages a bead to the cable to prevent the mat from becoming dislodged from the ground. Although this system works reasonably well for securing mats to the ground, the system involves several drawbacks.

First, the system typically requires multiple installers, one to generate sufficient upward force to eliminate any slack in the cable, while a second installer crimps the bead to the cable. Another drawback associated with the prior art is that the system typically involves a complex securement of the cable to the anchor. This requires the anchor to be associated with a predetermined length of cable, which must be cut to size with the remainder discarded. This leads to undesired waste and severely limits the use of the system in areas where a securement lower than the predetermined length of the cable is desired.

Another drawback associated with prior art is the lack of resiliency associated with the cable. Even using multiple installers, the system typically does not provide significant bias of the mat into the ground. As the installation system typically results in at least a small amount of "play" between the mat and the ground, effluent can often move underneath the mat, causing undesired erosion and additional play between the mat and the ground. If the play becomes substantial enough, the anchor can become dislodged, allowing the mat to move away from the erosion susceptible surface, thereby defeating the purpose of the mat.

Another drawback associated with the prior art is the weight of the prior art anchoring systems. While the weight of one anchor system is of only marginal consequence, the cost of transporting and moving a large number of anchors makes the use of heavy anchors and cables undesirable. Still another drawback associated with the prior art is the difficulty in removing the anchor system if it is desired to remove the mat. Typically, removal requires multiple installers with the first installer pulling upward on the bead sufficiently to allow the second installer to move bolt cutters between the bead and the mat. The difficulties encountered in the prior art discussed hereinabove are substantially eliminated by the present invention.

SUMMARY OF THE INVENTION

In an advantage provided by this invention, an erosion control mat anchor system is provided which is of a lightweight, low cost manufacture.

Advantageously, this invention provides an erosion control mat anchor system which is easy to install.

Advantageously, this invention provides an erosion control mat anchor system which is easy to remove.

Advantageously, this invention provides an erosion control mat anchor system which is adjustable to accommodate anchoring at various depths.

Advantageously, this invention provides an erosion control mat anchor system which biases an erosion control mat toward the ground.

Advantageously, this invention provides an erosion control mat anchor system which allows for quick installation without heavy or costly tools.

Advantageously, in a preferred example of this invention, an erosion control mat anchor system is provided. The erosion control mat anchor system includes an anchor and means for positioning the anchor at least five centimeters below ground. A line is coupled from above ground to the anchor. A one way retainer is coupled to the line in a manner which allows the retainer to move in a first direction along the line, which prevents movement of the retainer in an opposite direction along the line. Preferably, the retainer is coupled to an erosion control mat to maintain the mat in contact with an erosion susceptible area. Preferably the line is resilient and stretched before being secured in place with the retainer to allow the line to bias the erosion control mat in position over the erosion susceptible area.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
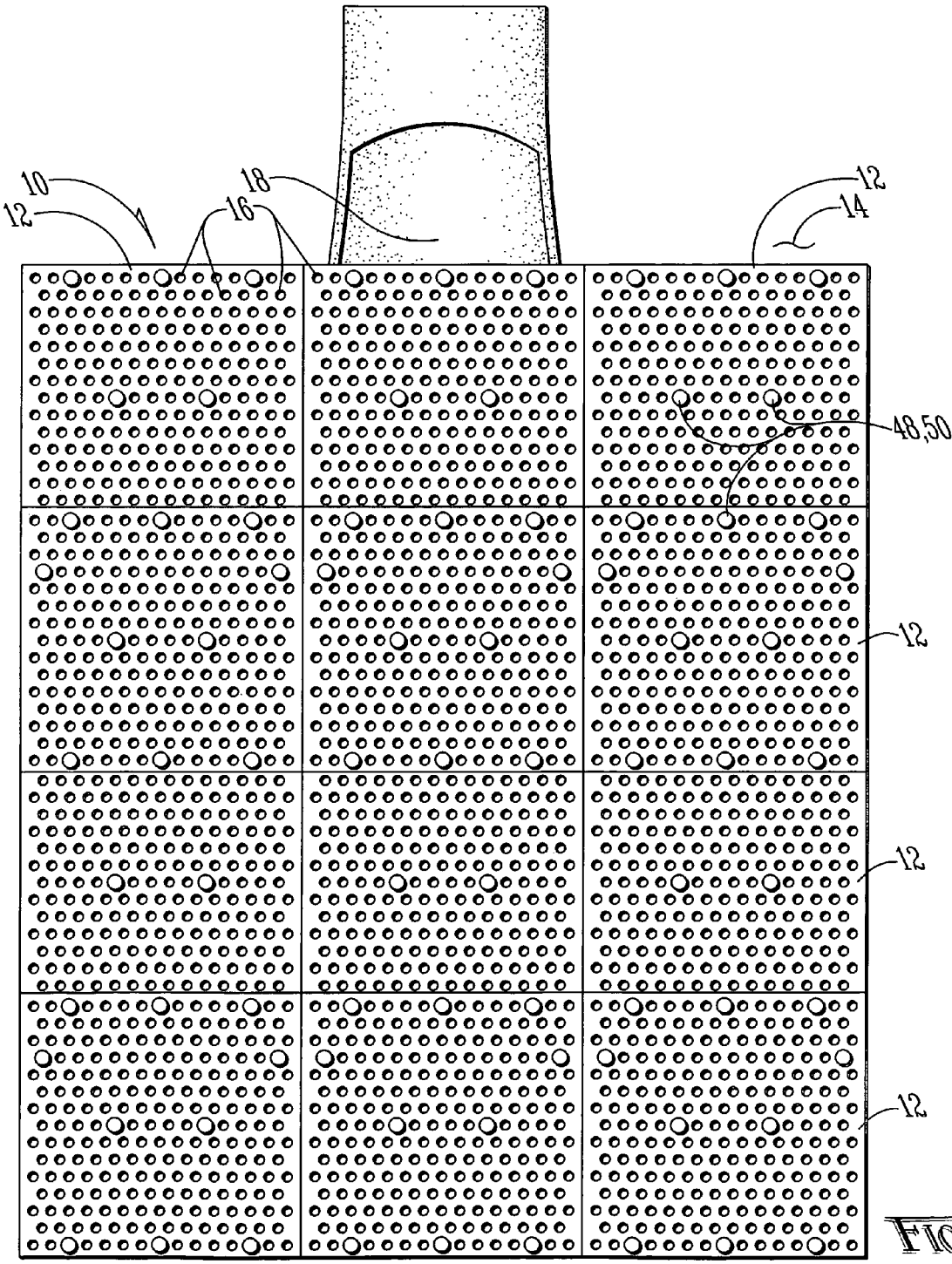
FIG. 1 illustrates a top plan view of a plurality of erosion control mats secured in place by the anchor system of the present invention at the outlet of an effluent discharge.

An erosion control mat anchor system according to this invention is shown generally as (10) in FIG. 1. A plurality of the systems (10) are shown securing a plurality of erosion control transition mats (12), such as those described in U.S. Letters Pat. No. 6,951,438, which is incorporated herein by this reference. The system (10) may, of course, be used in association with any type of erosion control surface, such as plastic sheeting, canvas, sod, a turf reinforcement mat, or any other erosion control surface. As shown, the anchor system (10) of the present invention is used to secure the erosion control mats (12) in an overlapped relationship. The anchor systems (10) provided at the upstream and downstream portions of the erosion control transition mats (12) extend through two erosion control transitions mats (12) tying them together, as well as securing them over the erosion susceptible surface (14), such as dirt, sod or secondary erosion control surface such as a turf reinforcement mat or the like. As shown in FIG. 1, the anchor system (10) extends through one of the holes (16) provided in the erosion control transition mats (12). The erosion control transition mat (12) can be secured in a non-overlapping, or any desired configuration. Similarly, any desired erosion control surface may be used instead of an erosion control transition mat (12). As shown, the erosion control transition mats (12) are provided at the mouth of an effluent discharge (18) which, in the preferred embodiment, is a concrete slab but may, of course, be any type of hard armor or any other type of effluent discharge known in the art.

Figure 2:
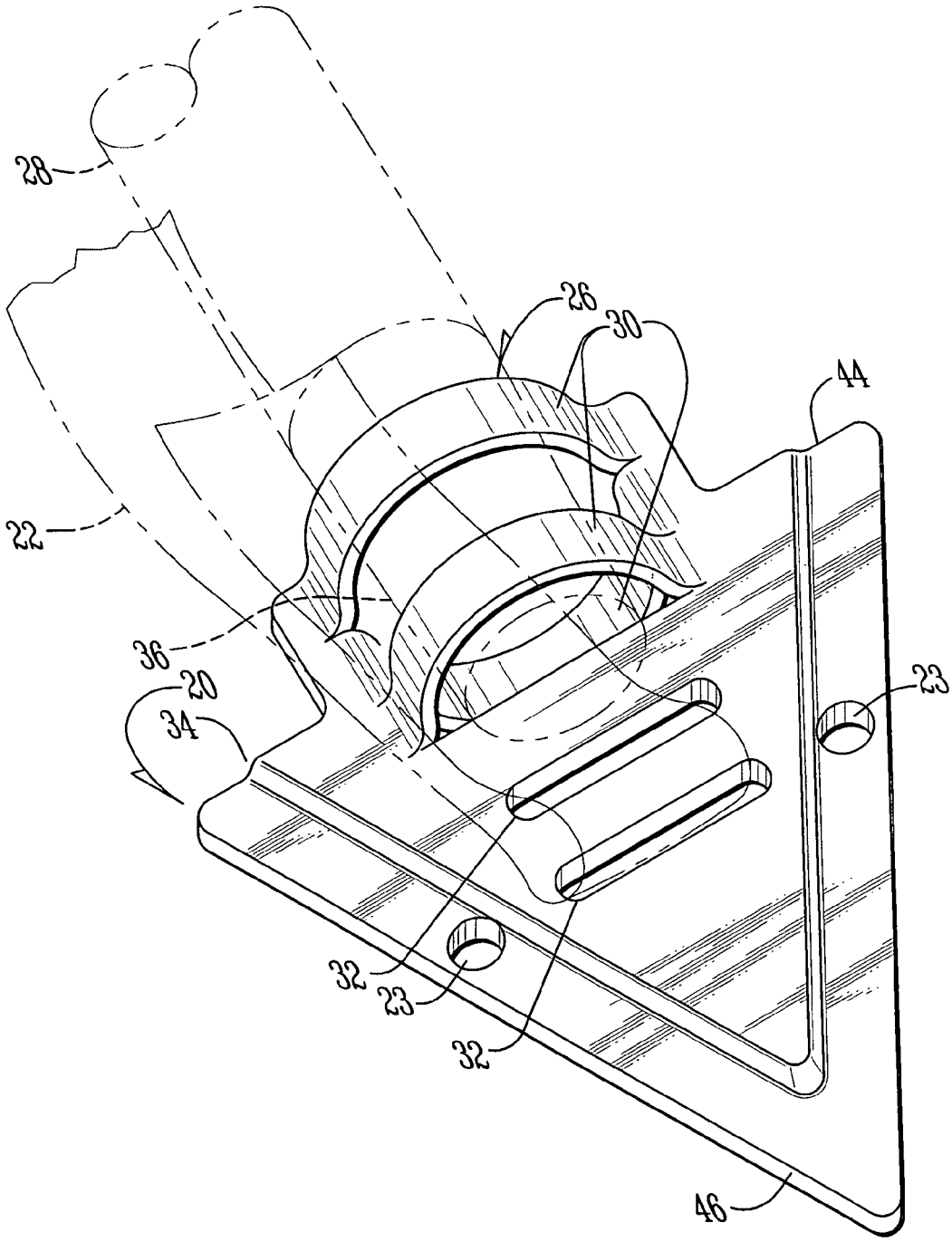
FIG. 2 illustrates a top perspective view showing the driving rod being positioned into the anchor for securement below ground.
Figure 3:
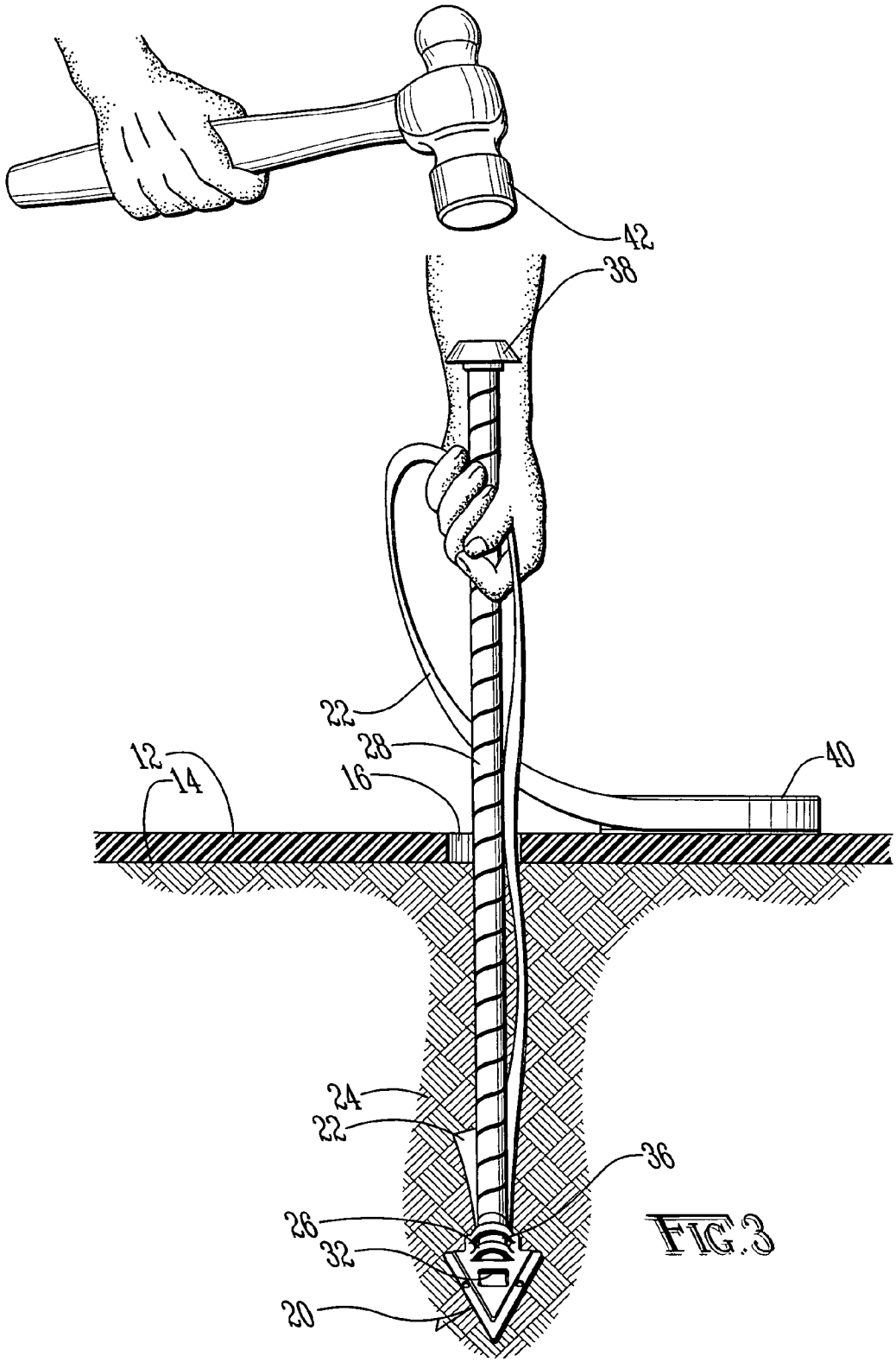
FIG. 3 illustrates a side elevation in partial cross-section of the driving rod positioning the anchor below the ground.
Figure 4:
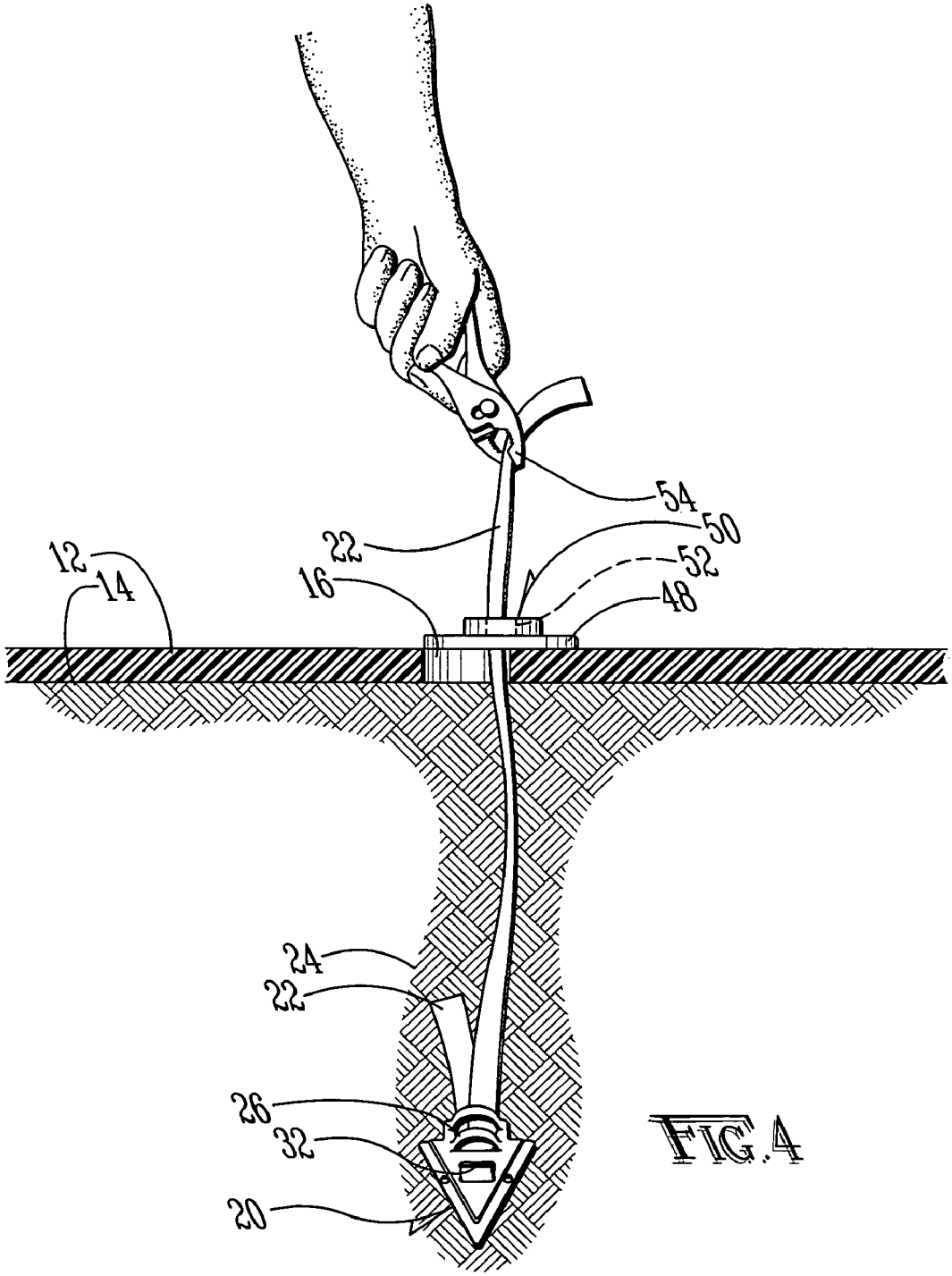
FIG. 4 illustrates a side elevation in partial cross-section of the anchor system of the present invention, shown securing an erosion control mat over an erosion susceptible surface.

As shown in FIG. 2, an anchor (20) is provided to secure a line such as a strap (22) into the ground (24). (FIGS. 2 and 3). As shown in FIG. 2, the anchor (20) is preferably stamped from a single sheet of steel to provide a tapered, four-sided structure. The anchor (20) is also preferably provided with holes (23) to allow the anchor (20) to be used in association with prior art cables (not shown) instead of the flat strap (22) of the present invention. While the anchor (20) may be constructed of any desired configuration, the tapered configuration allows the anchor (20) to be easily inserted into the ground (24), while reducing damage to the anchor (20) during insertion. Preferably, the anchor (20) is die cut and bent in a manner known in the art to provide a tapered retaining slot (26) to receive the driving rod (28). The slot (26) is defined by a plurality of ribs (30), but may be defined by an extra piece secured to the anchor (20), or may be integrally cast into the anchor (20) as desired.

As shown in FIG. 2, the anchor (20) is provided with a plurality of slots (32) to receive the strap (22) which is woven therein. The slots (32) are preferably provided of a size, configuration and orientation so as to lock the strap (22) into place as the anchor (20) is inserted into the ground (24) by the driving rod (28). Below the slots (32) the anchor (20) is preferably stamped into a corrugation (34), so as to disrupt the ground (24) as the anchor (20) is inserted therein. The corrugation (34) prevents the ground (24) from shearing the strap (22) against the sides of the slots (32). The strap (22) is preferably flexible and resilient. In the preferred embodiment, the strap is constructed of woven nylon, fiberglass or any other suitable material known in the art. Preferably, the strap (22) is treated and/or constructed of a material designed to resist degradation associated with ultraviolet radiation, heat, cold and submersion in water, as well as any other elements to which the system (10) is to be subjected.

When it is desired to insert the anchor (20) into the ground, the driving rod (28) is secured into the slot (26) defined by the ribs (30). The ribs (30) are vertically offset from the slots (32) so that the strap (22) does not interfere with the driving rod (28) during insertion of the anchor (20). Preferably, the driving rod (28) is constructed of steel and provided with a tapered end (36), configured to fit into a mating engagement with the slot (26). The opposite end of the driving rod (28) is preferably provided with a head (38) to provide a striking surface during insertion of the driving rod (28) into the ground (24). (FIG. 3). Once the strap (22) has been woven into the slots (32) of the anchor (20), and the driving rod (28)

secured within the slot (26), the erosion control transition mat (12) is positioned as desired over the erosion susceptible surface (14). Thereafter, the driving rod (28) is used to insert the anchor (20) through one of the holes (16) in the erosion control transition mat (12) and into the ground (24).

Depending upon the type of ground (24) into which the anchor (20) is to be inserted, the driving rod (28) is used to insert the anchor (20) deeper or shallower so as to attain the desired anchoring of the erosion control transition mat (12) relative to the erosion susceptible surface (14). In very hard ground (24), the anchor (20) may be inserted shallow, while in loose dirt or sand the anchor (20) must be provided more deeply to obtain a similar amount of anchoring. The strap (22) is preferably provided on a spool (40) to allow the desired amount of strap (22) to be inserted into the ground (24) with minimal waste. To assist in driving the anchor (20) into the ground, a hammer (42) or the like may be used to strike the driving rod (28) on the head (38).

Once the driving rod (28) has been used to drive the anchor (20) to the desired depth, the driving rod (28) is pulled upward. As the top surface (44) of the anchor (20) is provided with a much greater surface area than the bottom (46) of the anchor (20), the anchor (20) inserts easily into the ground (24), but resists upward movement of the anchor (20) relative to the ground (24). Accordingly, as the driving rod (28) is pulled upward, the tapered end (36) of the driving rod (28) exits the slot (26), leaving the anchor (20) imbedded into the ground (24). After the driving rod (28) has been removed, the strap (22) is pulled upward to "set" the anchor (20) into the ground (24). Once the anchor (20) has been set, the strap (22) is cut, preferably ten to twenty centimeters above the top of the erosion control transition mat (12). Thereafter, a washer (48), such as those known in the art, is positioned over the strap (22) and set on the erosion control mat (12). Preferably, the washer (48) is constructed of nylon or other strong weather resistant material and is preferably provided of a diameter greater than the hole (16) through which the strap (22) extends.

A one-way button (50) is then provided over the strap (22) and secured over the washer (48). Preferably, the one-way button (50) is provided of a weather resistant material. The button (50) is provided with an opening (52) having a one-way mechanism, such as those known in the art, to allow the strap (22) to move in a first direction, but which prevents movement of the strap (22) in an opposite direction through the opening (52). To set the button (50) in place, the strap (22) is preferably pulled upward with pliers (54), or the like, while the button (50) is pushed downward. By stretching the strap (22) with the pliers (54), when the button (50) is in place and the pliers (54) released, the resiliency of the strap (22) pulls against the one-way button (50), forcing the erosion control transition mat (12) into contact with the erosion susceptible surface (14). As shown in FIG. 1, preferably a plurality of anchor systems (10) are provided as desired to secure the erosion control transition mats (12) as needed.

Figure 5:
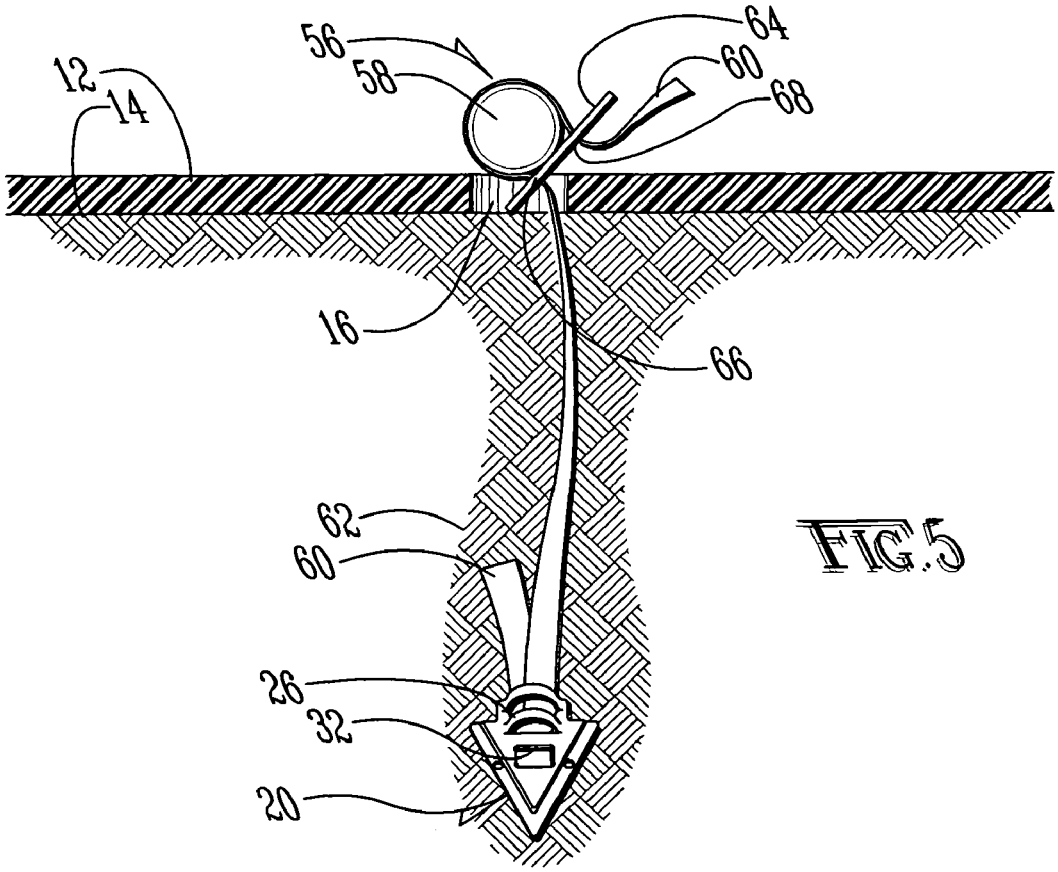
FIG. 5 illustrates a side elevation in partial cross-section of an alternative embodiment of the present invention, shown locking the strap around a portion of the erosion control mat.

FIG. 5 shows an alternative embodiment of the present invention in which the erosion control transition mat (56) is provided with a support bar (58) having a circular cross-section. The support bar (58) may be integrally formed as part of the erosion control transition mat (56), or may otherwise be secured to the erosion control transition mat (56). As shown in FIG. 5, the strap (60) is anchored into the ground (62) in a manner such as that described above for the preferred embodiment. A button (64) is then provided with two slots (66) and (68). Although one or both of the slots (66) and (68) may be of a one-way construction such as that noted above, in the preferred embodiment both of the slots (66) and (68) are provided of a one-way construction. Accordingly, the strap (60) is threaded through the first slot (66), around the support bar (58) and back through the second slot (68). The strap (60) is preferably secured by pulling on the strap (60) with pliers or other retention means to stretch the strap (60) so that when the pliers (not shown) are released, the resiliency of the strap (60) pulls the support bar (58) and erosion control transition mat (56) into the ground (62).

The foregoing description and drawings merely explain and illustrate the invention, and the invention is not limited thereto, except insofar as the claims are so limited, as those skilled in the art that have the disclosure before them will be able to make modifications and variations therein without departing from the scope of the invention. The anchor system (10) may, of course, be utilized with any desired strap (22) constructed of any suitable material, including, but not limited to, metal or rope. Similarly, any desired type of retainer may be utilized which allows the strap to move in a first direction relative to the retainer and prevents the strap from moving in a second direction relative to the retainer.

What is claimed is:

1. An anchor system comprising:

an anchor, wherein said anchor includes an aperture, and a corrugation located between said aperture and a leading edge of said anchor;

a driving rod;

a line coupled to said anchor through said aperture;

a one-way catch coupled to said line along said line; and an erosion control surface positioned between said anchor and said one-way catch, said erosion control surface comprising a semi-rigid, planar mat having a plurality of apertures therethrough and disposed at least partially overlapping a soft armor of an effluent discharge, wherein said line passes through one of said plurality of apertures in said erosion control surface and is manually tensioned to bias said erosion control surface against a ground surface.

2. The anchor system of claim 1, wherein said driving rod is a pole.

3. The anchor system of claim 1, wherein said anchor is tapered.

4. The anchor system of claim 1, wherein said line is resilient and biases said erosion control mat toward said anchor.

5. The anchor system of claim 4, wherein said erosion control surface is at least one centimeter thick.

6. The anchor system of claim 1, wherein said corrugation disrupts the soil material of a ground surface into which said anchor is inserted to reduce shearing of said line during installation of said anchor.

7. An erosion control anchor system comprising;

(a) an erosion control surface provided with an opening;

(b) a resilient line passing through said opening, wherein said line is provided with a first end and a second end;

(c) an anchor positioned at least five centimeters below-ground, wherein said anchor includes a plurality of ribs located near a top portion of said anchor that form a retaining slot of suitable dimensions to accept an end of a driving rod, an aperture configured to receive said resilient line, and a corrugation located between said aperture and a leading edge of said anchor, wherein said corrugation disrupts the soil material of a ground surface into which said anchor is inserted to reduce shearing of said resilient line during installation of said anchor;

(d) a retainer coupled to said resilient line; and (e) a one-way catch coupled to said retainer along said resilient line;

wherein said resilient line is threaded through said retainer, with said first end and said second end of said resilient line extending from said retainer, and wherein said resilient line biases said erosion control mat toward said anchor.

8. The erosion control anchor system of claim 7, wherein said line is flat.

9. The erosion control anchor system of claim 7, further comprising a driving rod coupled to said anchor.

10. A method for securing an erosion control surface to the ground comprising:

(a) providing a resilient line;

(b) providing an anchor, wherein said anchor includes a plurality of ribs located near a top portion of said anchor that form a retaining slot of suitable dimensions to accept an end of a driving rod, an aperture configured to receive said resilient line, and a corrugation located between said aperture and a leading edge of said anchor, wherein said corrugation disrupts the soil material of a ground surface into which said anchor is inserted to reduce shearing of said resilient line during installation of said anchor;

(c) securing said line to said aperture of said anchor;

(d) positioning said anchor at least five centimeters below-ground;

(e) providing an erosion control surface;

(f) positioning said line through an opening provided in said erosion control surface;

(g) providing a retainer;

(h) providing said retainer with a one-way catch;

(i) threading said resilient line into and out of said retainer across said one way catch; and (h) manually pulling by hand or by hand with the aid of a hand tool said resilient line through said retainer in a manner which secures said erosion control surface to the ground, wherein said resilient line is stretched and biases said erosion control surface toward the ground.

11. The method of claim 10, further comprising securing said retainer to said resilient line in an manner in which said resilient line does not wind around upon itself more than one time.

12. The method of claim 10, further comprising:

(a) providing a driving rod; and (b) inserting said anchor into the ground with said driving rod coupled to retaining slot in said anchor.

* * * * *